United States Patent [19]

Geiger

[11] 3,992,121

[45] Nov. 16, 1976

[54] DECK AND ROADWAY GAP SEALING ASSEMBLY

[75] Inventor: Kermit K. Geiger, Carpentersville, Ill.

[73] Assignee: Felt Products Mfg. Co., Skokie, Ill.

[22] Filed: Jan. 19, 1976

[21] Appl. No.: 650,122

[52] U.S. Cl. ..... 404/47; 14/16.5; 52/396; 404/67

[51] Int. Cl.[2] ..... E01C 11/02

[58] Field of Search ..... 14/16.5; 404/67, 66, 404/68, 47, 48; 52/396

[56] References Cited

UNITED STATES PATENTS

| | | | |
|---|---|---|---|
| 3,713,368 | 1/1973 | McDowell | 404/67 |
| 3,733,647 | 5/1973 | Jakel | 404/47 X |
| 3,814,530 | 6/1974 | Neff | 404/67 |
| 3,827,817 | 8/1974 | Czernik | 404/67 |

*Primary Examiner*—Nile C. Byers
*Attorney, Agent, or Firm*—Dressler, Goldsmith, Clement, Gordon & Shore, Ltd.

[57] ABSTRACT

End dam assemblies for sealing a gap between adjacent roadway or deck slabs comprise a series of elongate elastomeric end dam sections which are assembled in end-to-end array. The end dam sections are provided with layers of porous material which confront and engage each other when adjoining end dam sections are secured together. The layers of porous material enhance securance of the end dam sections to each other by providing an auxiliary material on each end dam section which is more easily bonded to the end dam sections and to each other than are the adjoining end dam sections directly to each other. The layers of porous material may also provide mechanical resistance to relative movement of the end dam sections.

15 Claims, 7 Drawing Figures

FIG. 4
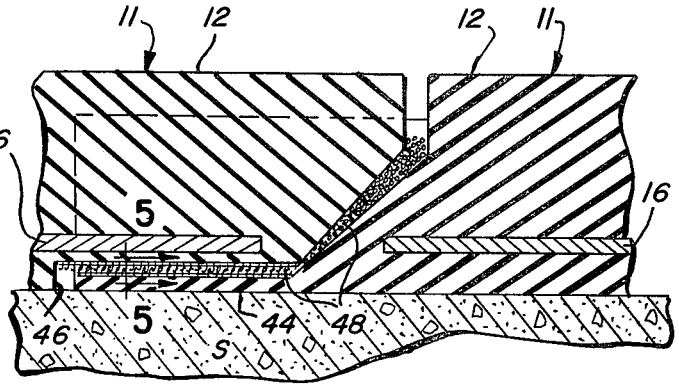
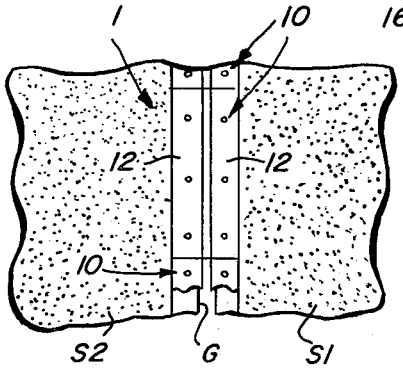
FIG. 1
FIG. 2
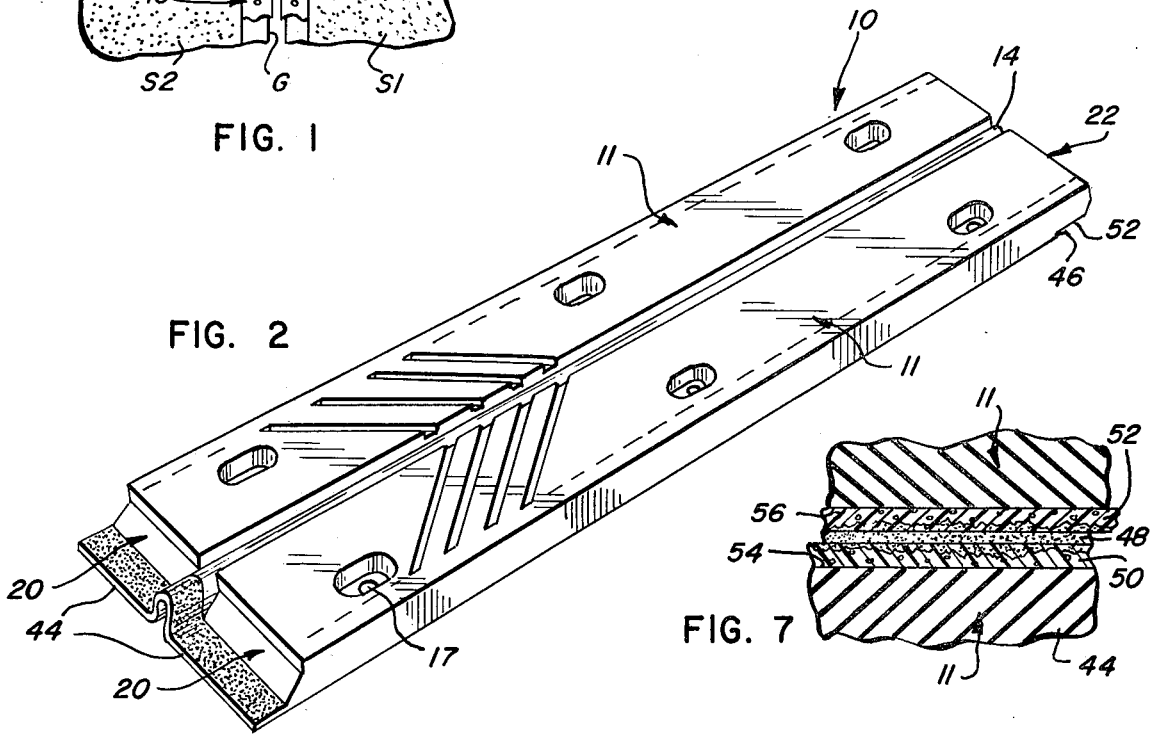
FIG. 7
FIG. 5
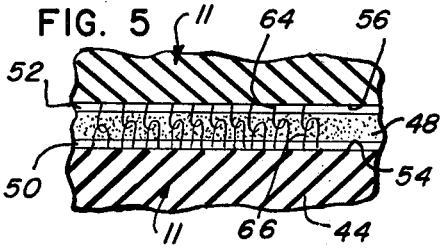
FIG. 6
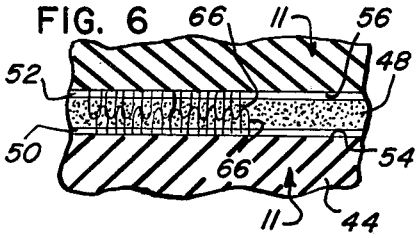
FIG. 3
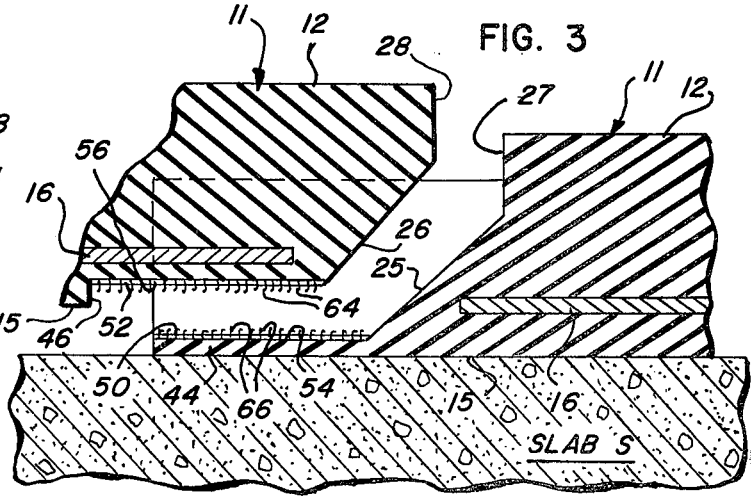

DECK AND ROADWAY GAP SEALING ASSEMBLY

This invention relates to an improvement in an end dam assembly for sealing a narrow gap between adjacent roadway or deck slabs, and more particularly, to an end dam assembly having end dam sections with an improved joint between longitudinally adjacent end dam sections.

Various proposals have been made for sealing the gap between adjacent roadway slabs. U.S. Pat. Nos. 3,713,368 and 3,827,817 disclose gap sealing devices for longitudinal, transverse and skewed roadway gaps. They provide improved constructions for sealing such gaps along the entire gap length.

Because end dam gap sealing devices cannot generally be manufactured or used in lengths adequate to accommodate the full length of roadway or deck slab gaps, end dam assemblies are normally comprised of a plurality of sections butted together in serial end-to-end array, and are sealingly secured to each other. The end dam sections themselves are preferably integrally formed, as from suitable elastomeric material, such as neoprene rubber, and provide end faces which must be sealed to provide a fully sealed end dam assembly.

Various efforts have been made to provide for effective sealing at the end faces of adjoining end dam assemblies. The sealing must necessarily be accomplished at the job site where conditions of suitable cleanliness and where conditions of close assembly tolerances cannot always be satisfied. One approach to providing an effective seal at the confronting end faces of end dam sections is shown in U.S. Pat. No. 3,827,817.

It is with an improved means for effecting the sealing securance of end dam sections to each other adjacent their ends with which this invention is concerned.

In accordance with the present invention, an improved joint assembly is provided for a pair of generally horizontally disposed adjacent, slightly spaced elongate roadway slabs which are supported for relative movement and which provide upper roadway surfaces. The joint assembly includes an elongate end dam assembly sealingly secured to the slabs at adjacent edges for sealingly bridging the narrow gap between the slabs.

The end dam assembly comprises a plurality of elongated sections abutting in end-to-end serial array. Each of the sections comprises at least one elastomeric pad, which may be formed of neoprene rubber, and has upper and lower surfaces and an end portion having a face at each of the opposite longitudinal ends. Each end face is in opposed abutting relationship with an opposite end face of a next adjacent pad.

To enhance securance of the end portions to each other, layers of porous material are secured to each of the end portions to provide an auxiliary material on each neoprene end portion which is more securely and positively bonded to the neoprene and to each other than is neoprene to neoprene. The bond between adjoining end portions is thereby substantially improved. In addition, the layers of porous material may provide enhanced mechanical resistance to relative lateral movement of the adjoining end dam sections. Suitable materials for the layers of porous material include hook and loop materials, felt, leather, terry cloth, sponge, foam, and a variety of woven and nonwoven fabrics.

Further objects, advantages and features of the invention will become apparent from the following description and drawings, of which:

FIG. 1 is a fragmentary plan view of a section of a roadway structure incorporating an end dam assembly of this invention;

FIG. 2 is an enlarged perspective view of an end dam section of this invention;

FIG. 3 is an exploded cross-sectional view of adjoining end dam sections of this invention;

FIG. 4 is a cross-sectional view similar to FIG. 3 and showing adjoining end dam sections sealed to each other;

FIG. 5 is an enlarged, fragmentary cross-sectional view taken along plane 5-5 in FIG. 4;

FIG. 6 is a fragmentary cross-sectional view showing another embodiment of the invention; and FIG. 7 is a fragmentary cross-sectional view showing another embodiment of the invention.

FIG. 1 illustrates a roadway joint assembly incorporating an elongated end dam assembly 1 of this invention. The joint assembly may be transverse of the roadway or may be longitudinal or skewed, all as illustrated in U.S. Pat. No. 3,713,368. That patent discloses how end dam assemblies of the type illustrated in the drawings herein may typically be used.

The end dam assembly 1 comprises a plurality of elongate end dam sections 10. Each end dam section 10 includes elongated side pads 11, each having an upper surface 12 which, when installed, acts as a portion of the upper roadway surface. Each pad 11 is sealingly secured to one of the generally horizontally disposed slabs S1, S2, and adjacent gap G, thereby bridging the gap between the narrowly spaced slabs.

Side pads 11 are generally rectangular in cross-sectional configuration and are sealingly secured to each other, as by a gap-bridging joint membrane 14 which has an upstanding arched configuration. Preferably membrane 14 is integral with side pad 11 and is reinforced with a fabric layer as is described in U.S. Pat. No. 3,713,368. Each end dam section 10 is desirably integrally molded, as of neoprene rubber, and each of the side pads embeds an elongate metal reinforcing plate 16. Plates 16 define suitable bolt holes 17 to receive bolts for anchoring side pads 11 to the slabs, all in accordance with the disclosure of the aforementioned patents.

As shown in FIG. 1, a longitudinal gap between adjoining roadway slabs is bridged by and sealed with a plurality of end dam sections 10 disposed in an end-to-end array. Each end dam section 10 is preferably formed so that it can be sealingly secured to the adjoining end dam section. Adjoining end dam sections 10 act cooperatively to provide the necessary sealing effect across gap G and between the end dam sections.

To longitudinally seal adjacent sections 10, end faces 20 and 22 at opposite ends of each side pad preferably are bevelled or tapered. End faces 20 and 22 define respective lower butting portions and non-complementary upper portions which may comprise inclined segments 25, 26 and vertical segments 27, 28, each respectively. Preferably, the segments 25, 26, 27 and 28 are flat surfaces. Inclined segments 25, 26 extend upwardly from a point adjacent the lower surfaces 15 of the side pads, and terminate upwardly at their points of intersection with vertical segments 27, 28. Vertical segments 27 and 28 extend from the lines of intersection with segments 25, 26 upwardly to the upper pad surface 12. Thus, the upper portion of the end faces 20 and 22 may be considered as comprising upper and lower planar or flat surfaces which intersect in lines parallel to upper surface 12.

As explained in greater detail in U.S. Pat. No. 3,827,817, in the preferred embodiment, the inclination angles of the lower inclined segments 25 and 26 are not quite complementary and define an inclined channel section therebetween which taperingly converges gradually downwardly and which is open in its upper regions. The vertical upper segments 27, 28 are also spaced apart and effectively comprise a vertical channel section which extends upwardly from the inclined channel section to the upper surfaces 12. Together the channel sections provide a channel across the entire width of the confronting end faces which effectively tapers downwardly to a point at which lower butting end face portions meet to provide a seal across the entire width of the confronting end faces. As such, the butting engagement is at area substantially less in cross-section than the full confronting cross-sectional area of the end faces, and preferably in the lower regions of the end faces making it possible to butt the ends more closely and to effect a seal between the end faces in the lower regions where it is most important to maintain a positive seal.

Joint membrane 14 projects outwardly from end faces 20 and is integral with longitudinal seal segments 44 which comprise thin membrane segments. The lower surfaces of side pads 11 at the ends having end faces 22 define notches 46 which receive seal segments 44 and which are generally complementary thereto. Seal segments 44 underlie and fit within notches 46 of an adjoining end dam section, and portions of joint membranes 14 of adjoining end dam sections overlie each other.

As disclosed in the aforementioned patents, a suitable adhesive may be interposed between confronting end faces 20 and 22, between overlapping areas of adjacent joint membranes 14, and between seal segments 44 and notches 46 to form a sealed joint between adjoining end dam sections. In accordance with this invention, the securance between adjoining end dam sections is substantially enhanced by interposing layers of porous material between the adjoining and confronting end portions to increase the receptivity of the surfaces to be sealingly bonded. That is accomplished by providing an auxiliary material on each of the confronting surfaces to be sealingly secured. The auxiliary material is more strongly bonded to the surfaces and to each other than the material of the surfaces, such as neoprene, would be bonded to each other. Adhesive is interposed between the layers of porous material when the surfaces are juxtaposed to maintain the layers in engagement with each other.

More specifically, a layer of porous material 50 is provided on the upper surface 54 of seal segments 44 and on the upper surface of the membrane 14. A further layer of porous material 52 is provided on the lower surface 56 of the notches 46 and on the adjacent lower surface of the joint membrane. Layers 50 and 52 are desirably moled with and to the end dam sections 10 during vulcanization by coating the end dam section locally with an adhesive, by juxtaposing the layers, and by placing the layers in contact with the rubber in a suitable vulcanization mold. Alternatively, layers 50 and 52 can be applied after vulcanization by buffing the surfaces 54 and 56 to which the layers are to be secured and by adhering the layers with a suitable adhesive. When this is done in-plant, the bond between the rubber and the porous material can be better controlled and can be more permanent than the typical bond provided in situ at a roadway installation site.

To sealingly secure end dam sections together, a suitable adhesive layer 48 is applied to the confronting surfaces of layers 50 and 52 (between the confronting end faces 20 and 22) and between overlying areas of adjacent joint membranes 14. Some of the adhesive impregnates the layers of porous material 50 and 52. The resulting bond between layers 50 and 52, which in turn are bonded to adjoining end dam sections 10, is stronger and more resistant to separation and shearing forces than is the typical bond between elastomeric surfaces which is formed directly between the rubber end dam sections 10 without the interposed layers of porous material 50 and 52. The joint formed thereby provides a more secure, watertight, and more permanent joint between adjoining end dam sections 10.

Not only is the joint between adjoining end dam sections 10 more secure and watertight, but the layers of porous material 50 and 52 may also provide enhanced mechanical resistance to relative movement between the end dam sections, for a number of reasons, including the fact that the substantially rougher surfaces tend to resist relative movement in shear. For example, layers 50 and 52 on seal segments 44 and 46 may comprise cooperating interlocking sheet layers, such as hook and loop layers of the general types illustrated in U.S. Pat. Nos. 2,717,437 and 3,009,235 and those available under the trademark VELCRO. One of the sheet materials, such as layer 52, has a plurality of hooks 64 of flexible resilient material projecting therefrom, and the other of the layers, layer 50, has a plurality of loops 66 of flexible resilient material projecting therefrom. The hooks 64 are operable to engage the loops 66 when the sheet materials are pressed together face-to-face to thereby cause the adjoining end dam sections 10 to tenaciously cling together to resist relative lateral movement. Where the processing of the assembly to secure the porous layer to the end dam section might act to destroy the hooks, it has been found advantageous to use confronting layers of loop material as shown in FIG. 6. This provides porous layers which when they confront each other tend to resist lateral movement and provides a pair of porous surfaces which may be impregnated with the adhesive to enhance the sealing and non-slip connection between adjacent end dam sections.

Other materials may be used as layers 50 and 52 to achieve the purposes of the present invention. Other than the hook-and-loop or loop-and-loop confronting materials, other porous materials which permit impregnation and provide a degree of resistance to relative lateral movement include felt, leather, terry cloth, sponge, foam, and a variety of woven and nonwoven fabrics.

When the interposed layers are relatively thick, when the confronting end dam sections are connected, those layers tend to fill the void between the confronting surfaces of the seal segments 50 and notches 52, thereby to enhance the seal. As shown in FIG. 7, materials such as foam or sponge are deformable and confrom under a low pressure to thereby fill the space between seal segments 44 and notches 46. In addition, the foam or sponge is somewhat shear-responsive, which in some cases may help to maintain the bond between adjoining end dam sections where there is a substantial skew in the roadway or when the joint is otherwise excessively stressed in shear.

While this invention is susceptible of embodiment in many different forms, there is shown in the drawing and has been described herein in detail a specific embodiment of the invention, with the understanding that the present disclosure is to be considered as an exemplification of the principles of the invention and is not intended to limit the invention to the embodiments illustrated. For example, it should be noted that this invention is applicable not only to pad means comprising a pair of side pads with a central gap bridging membrane, but also to end dams in which a unitary pad means is anchored at both sides of the gap and bridges the gap as well. The end portions of such end dams may also include layers of porous material to provide advantages in accordance with this invention.

I claim:

1. In a deck joint assembly having an elongate end dam assembly for sealing a narrow gap between adjacent, relatively movable roadway slabs, said end dam assembly comprising a series of elongate elastomeric end dam sections abutting in end-to-end serial array, each of said end dam sections sealingly spanning said gap and providing an elastomeric end portion confronting the next adjacent end dam section for sealing securance thereat and therebetween, the improvement comprising means for enhancing securance of said end portions to each other, said enhancing means comprising layers of porous material secured to each of said end portions, said layers on adjoining end portions confronting and engaging each other for mechanically resisting relative movement, and an adhesive for maintaining said layers in engagement with each other.

2. The deck joint assembly as defined in claim 1 wherein said layers of porous material comprise coooperating sheet materials on said adjoining end portions which interlock when said sheet materials are pressed together face-to-face, one of said sheet materials having a plurality of hooks of flexible resilient material projecting therefrom, and the other of said sheet materials having a plurality of loops of flexible resilient material projecting therefrom, said hooks being operable to hook onto said loops when said sheet materials are pressed together face-to-face thereby to cause said adjoining end portions to cling together in a non-slip connection.

3. The deck joint assembly as defined in claim 1 wherein said porous material is a foam material.

4. The deck joint assembly as defined in claim 1 wherein said porous material is a fabric.

5. The deck joint assembly as defined in claim 1 wherein said layers of porous material are each secured to their respective end dam sections by an adhesive.

6. The deck joint assembly as defined in claim 1 wherein said end portions include thin membrane segments which project longitudinally from one end of each end dam section and have an upper surface portion for underlying and being sealingly secured to a lower surface portion against an opposite end of the next adjoining end dam section, said layers of porous material being secured to said upper surface portion of said membrane segment and said lower surface portion of said next adjoining end dam section to secure said end dam sections together.

7. The deck joint assembly as defined in claim 6 wherein said layers of porous material are proportioned to fill the space between said upper surface portion of each membrane segment and said lower surface portion of each adjoining end dam section, said material being deformable to assist in maintaining securement between adjoining end dam sections and to enhance the seal between said end dam sections.

8. The deck joint assembly as defined in claim 1 wherein said layers of porous material each comprises a layer of material having a plurality of loops of flexible resilient material projecting toward the confronting layer, said loops engaging each other for mechanically resisting relative movement of adjacent end dam sections to each other.

9. In a road joint assembly comprising a pair of generally horizontally disposed elongate adjacent slabs supported for relative movement, providing upper roadway surfaces and being adjacent each other, said pair of slabs being narrowly spaced from each other to define a narrow gap therebetween, an elongate end dam assembly sealingly secured to said slabs at adjacent edges and sealingly bridging said gap, said end dam assembly comprising a plurality of elongate end dam sections abutting in end-to-end serial array, each of said end dam sections comprising a pair of elongated elastomeric pads each having an upper and a lower surface and a pair of end faces respectively at opposite ends, a thin elastomeric joint membrane secured to each of said side pads along their length and sealingly spanning the space between said pads and spanning said gap, said joint membrance being substantially thinner than said side pads and assuming an upstanding arched configuration in transverse cross-section, one of said end faces being in opposed relationship with an end face of a next adjacent pad, thin membrane segments projecting longitudinally from one end of each said end dam section and having an upper surface portion for underlying and for being sealingly secured to a lower surface portion adjacent an opposite end of the next adjoining end dam section, thereby to sealingly secure said end dam sections to each other, the improvement comprising means for enhancing securance of said end dam sections to each other, said enhancing means comprising a first layer of porous material secured to said upper surface portion of each of said thin membrane segments and a second layer of porous material secured to said lower surface portion of each next adjoining end dam section, said first and second layers of porous material confronting and engaging each other for mechanically resisting relative movement, and an adhesive for maintaining said layers in engagement with each other.

10. The deck joint assembly as defined in claim 9 wherein said layers of porous material comprise cooperating sheet materials on said adjoining end dam sections which interlock when said sheet materials are pressed together face-to-face, one of said sheet materials having a plurality of hooks of flexible resilient material projecting therefrom, and the other of said sheet materials having a plurality of loops of flexible resilient material projecting therefrom, said hooks being operable to hook onto said loops when said sheet materials are pressed toghether face-to-face thereby to cause said adjoining end dam sections to cling toghether in a non-slip connection.

11. The deck joint assembly as defined in claim 9 wherein said layers of porous material each comprises a layer of material having a plurality of loops of flexible resilient material projecting toward the confronting layer, said loops engaging each other for mechanically resisting relative movement of adjacent end dam sections to each other.

12. The deck joint assembly as defined in claim 9 wherein said porous material is a foam material.

13. The deck joint assembly as defined in claim 9 wherein said porous material is a fabric.

14. The deck joint assembly as defined in claim 9 wherein said layers of porous material are each secured to their respective end dam sections by an adhesive.

15. The deck joint assembly as defined in claim 9 wherein a notch is provided along the opposite end of each said end dam section and said lower surface portion defines the upper wall of said notch, said notch being complementary to said membrane segment, said membrane segment of one end dam section being receivable in said notch in an adjoining end dam section for sealingly securing toghether said adjoining end dam sections, whereby opposite ends of like end dam sections may be positioned in said end-to-end serial array.

* * * * *